United States Patent [19]

Secemski et al.

[11] Patent Number: 5,049,303

[45] Date of Patent: Sep. 17, 1991

[54] DETERGENT COMPOSITIONS CONTAINING A MIXTURE OF AN ETHYLENE OXIDE/PROPYLENE OXIDE BLOCK COPOLYMER AND A POLYCARBOXYLATE

[75] Inventors: Isaac I. Secemski, Flushing, N.Y.; Jesse L. Lynn, Oradell, N.J.

[73] Assignee: Lever Brothers Company, Division of Conopco, Inc., New York, N.Y.

[21] Appl. No.: 269,382

[22] Filed: Nov. 9, 1988

[51] Int. Cl.[5] ..... C11D 3/395

[52] U.S. Cl. ..... 252/548; 252/550; 252/551; 252/555; 252/174.21; 252/174.22; 252/174.24; 252/DIG. 1; 252/DIG. 2

[58] Field of Search ..... 252/174.21, 174.22, 252/174.24, 548, 550, 555, 551, DIG. 1, DIG. 2

[56] References Cited

U.S. PATENT DOCUMENTS

| | | | |
|---|---|---|---|
| 4,654,159 | 3/1987 | Bush et al. | 252/95 |
| 4,720,399 | 1/1988 | Taha | 252/174.21 |
| 4,906,397 | 3/1990 | Leighton et al. | 252/174.24 |

FOREIGN PATENT DOCUMENTS 61-287996 12/1986 Japan .

*Primary Examiner*—John F. Niebling
*Assistant Examiner*—Isabelle R. McAndrews
*Attorney, Agent, or Firm*—James J. Farrell

[57] ABSTRACT

The present invention relates to detergent compositions comprising an organic surfactant, a non-phosphate detergent builder, an ethylene oxide/propylene oxide block copolymer and a polycarboxylate.

10 Claims, No Drawings

DETERGENT COMPOSITIONS CONTAINING A MIXTURE OF AN ETHYLENE OXIDE/PROPYLENE OXIDE BLOCK COPOLYMER AND A POLYCARBOXYLATE

TECHNICAL FIELD

The present invention relates to detergent compositions comprising an organic surfactant, a non-phosphate detergent builder, an ethylene oxide/propylene oxide block copolymer and a polycarboxylate.

BACKGROUND OF THE INVENTION

Ethylene oxide/propylene block copolymers have been utilized in detergent as surfactants. A variety of such block copolymers is commercially available from BASF Wyandotte Corporation of Wyandotte, Mich. under the tradename Pluronic® surfactants, Pluronic® R surfactants, Tetronic® surfactants and Tetronic® R surfactants.

Polycarboxylates have been utilized as detergency builders. For example, U.S. Pat. No. 3,128,287, U.S. Pat. No. 3,635,830, U.S. Pat. No. 4,144,226, U.S. Pat. No. 4,146,495 and European patent application 192,441, published Aug. 27, 1986, disclose certain ether carboxylates as detergency builders. U.S. Pat. No. 3,933,673 describes the use of partial alkali metal salts of homo or copolymers of unsaturated aliphatic mono-or polycarboxylic acids as builders.

U.S. Pat. No. 4,657,693 discloses a spray dried detergent composition comprising a nonsoap anionic detergent surfactant, an alkali metal tripolyphosphate detergent builder and certain mixtures of a polyethylene glycol and a polyacrylate. It is stated that the polyacrylate/polyethylene glycol mixtures provide a boost to dispersion rates in cold water and improvement in physical properties.

U.S. Pat. No. 4,490,271 discloses a granular detergent composition comprising an organic surfactant, a nonphosphorous detergent builder and a certain mixtures of a polyethylene glycol and polyacrylate. It is stated that such polyacrylate/polyethylene glycol mixtures provide a boost to the removal of clay soils.

It has now been discovered that detergent compositions comprising a nonphosphorous detergent builder that contain mixtures of certain ethylene oxide/propylene oxide block copolymers and certain polycarboxylates provide a surprising boost to the removal of clay soils.

SUMMARY OF THE INVENTION

The present invention encompasses a detergent composition comprising:

(a) from 5% to about 50% by weight of an organic surfactant selected from the group consisting of anionic, cationic, nonionic, zwitterionic and ampholytic surfactants, and mixtures thereof;

(b) from 5% to about 80% by weight of a nonphosphorous detergent builder; and (c) from about 1% to about 30% of a mixture of an ethylene oxide/propylene oxide block copolymer and a polycarboxylate, in which mixture the ethylene oxide/propylene oxide block copolymer: polycarboxylate weight ratio is from about 1:10 to about 10:1, said ethylene oxide/propylene oxide block copolymer having a weight average molecular weight of from about 1,000 to about 50,000, wherein said ethylene oxide/propylene oxide block copolymer comprises at least about 70% ethylene oxide by weight and said polycarboxylate comprises a homopolymer or a copolymer formed of monomers having the general formula:

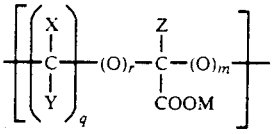

wherein

X, Y and Z are each selected from the group consisting of hydrogen, COOM, methyl, carboxymethyl, hydroxy and hydroxymethyl;

each M is selected from the group consisting of hydrogen, alkali metal, ammonium and substituted ammonium;

m is 0 or 1;

q is 0 or 1;

r is 0 or 1; with the proviso that:

(i) m plus r is 0 or 1, and (ii) when m is 0, then q is 1; and the weight average molecular weight of said polycarboxylate is from about 2,000 to about 100,000.

DETAILED DESCRIPTION OF THE INVENTION

The detergent compositions of the present invention comprise an organic surfactant, a nonphosphorous detergent builder and a mixture of certain ethylene oxide/propylene oxide block copolymers and certain polycarboxylates. It has been discovered that the mixture of certain ethylene oxide/propylene oxide block copolymers and certain polycarboxylates provides a surprising boost to the removal of clay soils by detergent compositions that contain a nonphosphorous detergent builder. Thus, detergent compositions that contain a nonphosphorous detergent builder and such mixtures provide more clay soil removal than such detergent compositions with the ethylene oxide/propylene oxide block copolymer or the polycarboxylate alone. Also, surprisingly, such boost to the removal of clay soil is not observed with detergent compositions that contain a phosphorous detergent builder and such mixture.

ORGANIC SURFACTANT

The detergent compositions herein contain from about 5% to about 50%, preferably from about 10% to about 30% and, most preferably from about 12% to about 25% by weight of an organic surfactant selected from the group consisting of anionic, cationic, nonionic, zwitterionic, and ampholytic surfactants, and mixtures thereof. Surfactants useful herein are listed in U.S. Pat. No. 4,396,520, Payne et al., issued Aug. 2, 1983, U.S. Pat. No. 3,664,961, Norris, issued May 23, 1972 and in U.S. Pat. No. 3,919,678, Laughlin et al. issued Dec. 30, 1975, each of which is incorporated herein by reference. Useful cationic surfactants also include those described in U.S. Pat. No. 4,222,905, Cockrell, issued Sept. 16, 1980, and U.S. Pat. No. 4,239,659, Murphy, issued Dec. 16, 1980, both incorporated herein by reference.

Water-soluble salts of the higher fatty acids, i.e., "soaps", are useful anionic surfactants in the compositions herein. This includes alkali metal soaps such as the sodium, potassium, ammonium, and substituted ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow or coconut soap.

Useful anionic surfactants also include the water-soluble salts, preferably the alkali metal, ammonium and substituted ammonium salts, of organic sulfuric acid reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms in straight chain or branched chain configuration, e.g., those of the type described in U.S. Pat. Nos. 2,220,099 and 2,477,383 both of which are incorporated herein by reference. Especially valuable are linear straight chain alkylbenzene sulfonates in which the average number of carbon atoms in the alkyl group is from 11 to 13, abbreviated as $C_{11-13}$LAS Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and from about 8 to about 12 carbon atoms in the alkyl group; and sodium or potassium salts of alkyl ethylene oxide ether sulfates containing from about 1 to about 25 units of ethylene oxide per molecule and from about 10 to about 20 carbon atoms in the alkyl group.

Other useful anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 9 to about 23 carbon atoms in the alkane moiety; and beta-alkyoxy alkane sulfonates containing from about 1 to 3 carbon atoms in the alkyl group and from about 8 to 20 carbon atoms in the alkane moiety.

Cationic surfactants comprise a wide variety of compounds characterized by one or more organic hydrophobic groups in the cation and generally by a quaternary nitrogen associated with acid radical. Quaternary nitrogen compounds also include nitrogen-containing ring compounds. Suitable anions are halides, methyl sulfate and hydroxide. Tertiary amines can have characteristics similar to cationic surfactants at washing solutions pH values less than about 8.5.

A more complete disclosure of cationic surfactants can be found in U.S. Pat. No. 4,228,044, issued Oct. 14, 1980, to Cambre, said patent being incorporated herein by reference.

Water-soluble nonionic surfactants are also useful in the compositions of the subject invention. Nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms in either a straight chain or branched chain configuration, with from about 3 to 12 moles of ethylene oxide per mole of alkyl phenol.

Preferred nonionics are the water-soluble condensation products of aliphatic alcohols containing from 8 to 22 carbon atoms, in either straight chain or branched chain configuration, with from about 3 to 15 moles of ethylene oxide per mole of alcohol. Particularly preferred are the condensation products of alcohols having an alkyl group containing from about 9 to about 15 carbon atoms with from about 4 to about 12 moles of ethylene oxide per mole of alcohol.

Other suitable nonionics are alkylpolysaccharides with a hydrophobic group containing from about 6 to about 30 carbon atoms and a polysaccharide hydrophilic group containing from about 1 to about 10 saccharide units.

Semi-polar nonionic surfactants useful herein include water-soluble amine oxides containing one alkyl moiety of from about 10 to about 18 carbon atoms and two moieties selected from the group consisting of alkyl groups and hydroxyalkyl groups containing from 1 to about 3 carbon atoms; and water-soluble sulfoxides containing one alkyl moiety of from about 10 to 18 carbon atoms and a moiety selected from the group consisting of alkyl and hydroxyalkyl moieties of from 1 to about 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium, and sulfonium compounds in which one of the aliphatic substituents contains from about 8 to about 18 carbon atoms.

Particularly preferred surfactants herein are anionic surfactants selected from the group consisting of the alkali metal salts of $C_{11-13}$ alkylbenzene sulfonates, $C_{12-18}$ alkyl sulfates, $C_{12-18}$ alkyl linear polyethoxy sulfates containing from about 1 to about 10 moles of ethylene oxide, and mixtures thereof and nonionic surfactants that are the condensation products of alcohols having an alkyl group containing from about 9 to about 15 carbon atoms with from about 4 to about 12 moles of ethylene oxide per mole of alcohol.

THE NONPHOSPHOROUS DETERGENT BUILDER

The compositions of the present invention also contain from about 5% to about 80%, preferably from about 10% to about 70%, and most preferably from about 15% to about 60%, by weight of a nonphosphorous detergent builder. The nonphosphorous detergent builder can be either organic or inorganic in nature.

Nonphosphorous detergent builders are generally selected from the various water-soluble, alkali metal, ammonium or substituted ammonium carbonates, and silicates. Preferred are the alkali metal, especially sodium salts of the above.

Specific examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

Suitable detergency builders are crystalline aluminosilicate exchange materials of the formula:

$$Na_z[(AlO_2)_z(SiO_2)_y]\times H_2O$$

wherein z and y are at least about 6, the molar ratio of z to y is from about 1.0 to about 0.5 and x is from about 10 to about 264. Amorphous hydrated aluminosilicate materials useful herein have the empirical formula:

$$M_z(zAlO_2ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by conventional analytical techniques, such as, for example, microscopic determination utilizing a scanning electron microscope. The crystalline aluminosilicate ion exchange materials herein are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{--}$exchange capacity of at least about 50 mg. eq. $CaCO_3$/g. (12 mg. $Mg^{++}$/g.) and a $Mg^{--}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicate or synthetically derived. A method for producing aluminosilicate ion exchange materials is discussed in U.S. Pat. No. 3,985,669, Krummel et al. issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material in Zeolite A has the formula:

$$Na_{12}[(AlO_2)_{12}(SiO_2)_{12}]\times H_2O$$

wherein x is from about 20 to about 30 especially about 27.

Water-soluble, nonphosphorus organic builders useful herein include the various alkali metal, ammonium and substituted ammonium, carboxylates, non-polymeric polycarboxylates and polyhydroxysulfonates. Examples of non-polymeric polycarboxylate builders are the sodium, potassium, lithium, ammonium and substituted ammonium salts of ethylenediaminetetraacetic acid, nitrilotriacetic acid, oxydisuccinic acid, mellitic acid, benzene polycarboxylic acids, and citric acid.

Other useful builders herein are sodium and potassium carboxymethyloxymalonate, carboxymethyloxysuccinate, cis-cyclohexanehexacarboxylate, cis-cyclopentanetetracarboxylate, and phloroglucinol trisulfonate.

Other suitable non-polymeric polycarboxylates are the polyacetal carboxylates described in U.S. Pat. No. 4,144,226, issued Mar. 13, 1979 to Crutchfield, et al. and U.S. Pat. No. 4,246,495 issued Mar. 27, 1979 to Crutchfield, et al., both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Other detergency builder materials useful herein are the "seeded builder" compositions disclosed in Belgian Patent No. 798,856, issued Oct. 29, 1973, incorporated herein by reference. Specific examples of such seeded builder mixtures are: 3.1 wt. mixtures of sodium carbonate and calcium carbonate having 5 micron particle diameter, 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron and a 3:3:1 wt. mixture of sodium carbonate, sodium aluminate and calcium oxide having particle diameter of 5 microns.

Preferably the builder is selected from the group consisting of zeolites, especially Zeolite A and amorphous aluminosilicates; carbonates, especially sodium carbonate; citrates, especially sodium citrate and silicates, especially sodium silicate.

Soaps, as described hereinbefore, can also act as builders depending upon the pH of the wash solution, the insolubility of the calcium and/or magnesium soaps, and the presence of the other builders and soap dispersants.

The compositions herein preferably contain as part of the nonphosphorous builder an alkali metal silicate having a molar ratio of $SiO_2$ to alkali metal oxide of from about 1.0 to about 3.2 and preferably from about 1.6 to about 2.4.

THE MIXTURE OF ETHYLENE OXIDE/PROPYLENE OXIDE BLOCK COPOLYMER AND POLYCARBOXYLATE

The detergent compositions of the present invention contain from about 1% to about 30%, preferably from about 1% to about 20% and more preferably from about 2% to about 10% by weight of a mixture of an ethylene oxide/propylene oxide block copolymer and a polycarboxylate. Also, the mixture of ethylene oxide/propylene oxide block copolymer and polycarboxylate is present in a weight ratio of from about 1:10 to about 10:1 and preferably from about 1:3 to about 3:1.

The ethylene oxide/propylene oxide block copolymers of the subject invention are based on the addition of ethylene oxide and propylene oxide to a low molecular weight organic compound containing one or more active hydrogen atoms. The block copolymer comprises at least about 70% and preferably at least about 80% ethylene oxide by weight and has a weight average molecular weight of from about 1,000 to about 50,000 and preferably from about 4,000 to about 30,000. Polymers based on addition of ethylene oxide and propylene oxide to propylene glycol and ethylene glycol are commercially available under the names Pluronic® and Pluronic® R, respectively, from BASF Wyandotte Corporation of Wyandotte, Michigan. Also, polymers based on the addition of ethylene oxide and propylene oxide to ethylenediamine are commercially available under the names Tetronic® and Tetronic® R from BASF Wyandotte Corporation.

The polycarboxylate of the present invention comprises a homopolymer or copolymer formed of monomers having the general formula:

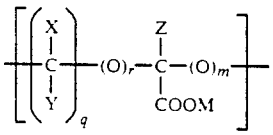

wherein

X, Y and Z are each selected from the group consisting of hydrogen, COOM, methyl, carboxymethyl, hydroxy and hydroxymethyl;

each M is selected from the group consisting of hydrogen, alkali metal, ammonium and substituted ammonium;

m is 0 or 1;

q is 0 or 1;

r is 0 or 1; with the proviso that:

(i) m plus r is 0 or 1, and (ii) when m is 0, then q is 1; and the weight average molecular weight of said polycarboxylate is from about 2,000 to about 100,000.

Preferably, X is hydrogen or hydroxy, Y is hydrogen or COOM; Z is hydrogen; m, r and q are, at the same time, 0, 0 and 1, respectively, or m, r, and q are, at the same time, 1, 0 and 0, respectively. It is preferred that the weight average molecular weight of the polycarboxylate is from about 4,000 to about 75,000.

The preferred polycarboxylates are polyacetal carboxylates and copolymers of sodium acrylate and sodium maleate.

The following nonlimiting examples illustrate the detergent compositions of the present invention and the criticality of the parameters of the detergent compositions of the present invention.

EXAMPLE I

A base composition of the following formula was utilized:

| | Weight Percent |
|---|---|
| Sodium linear alkylbenzene sulfonate (LAS) | 18 |
| Sodium carbonate | 35 |
| Sodium silicate | 3 or 20* |
| Sodium carboxymethyl cellulose | 0.3 |
| Sodium sulfate | to 100% |

*All runs were done with 20% sodium silicate unless otherwise stated.

Detergency evaluations with the base composition and the indicated amounts of the mixture ethylene oxide/propylene oxide block copolymer and polycarboxylate and other mixtures, as indicated hereinbelow, were performed in a Terg-o-tometer at 100° F. and 30 ppm, 90 ppm and 150 ppm water hardness (Ca/Mg ratio is 2:1) using swatches stained with clay soil. The base composition was dosed at 1.50–1.57 grams/liter and was added over-the-side as a premeasured solution.

All the data is presented as Δ% Detergency where

Δ% Detergency = % Detergency with a mixture of ethylene oxide/propylene oxide block copolymer and polycarboxylate or other mixtures, as indicated hereinbelow, minus % Detergency without the mixture.

Also, % Detergency is the average of the runs at the three water hardnesses.

EXAMPLE II

The following compounds were evaluated:

The following are the generic formulas of the ethylene oxide/propylene oxide block copolymers utilized in the following examples:

1. Pluronic® is based on addition of propylene oxide to the two hydroxyl groups of propylene glycol followed by ethylene oxide addition to sandwich this hydrophobe between hydrophilic groups.

The structure is:

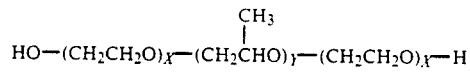

2. Pluronic® R is based on addition of ethylene oxide to ethylene glycol followed by propylene oxide addition to sandwich this hydrophile between hydrophobic groups.

The structure is:

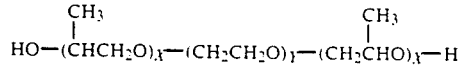

3. Tetronic® is based on sequential addition of propylene oxide and ethylene oxide to ethylenediamine.

The structure is:

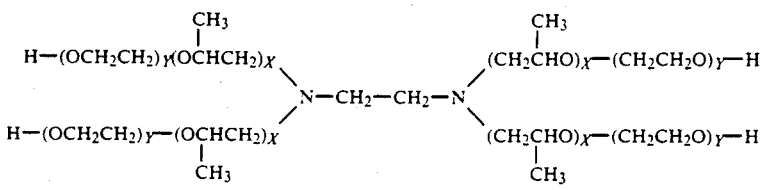

4. Tetronic ® R is based on sequential addition of ethylene oxide and propylene oxide to ethylenediamine. The structure is:

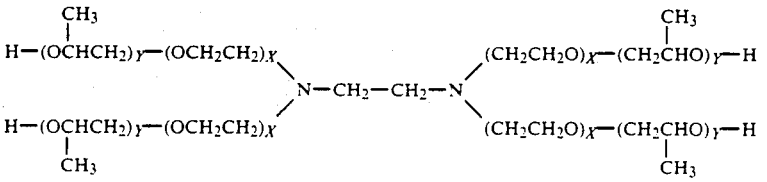

wherein in each of the above general formulas each X and Y is an integer.

The following compounds were evaluated:

1. Pluronic ® F98, M.W. 13,000, HLB 28, 80% EO by wt.
2. Pluronic ® L92, M.W. 3,650, HLB 5.5, 20% EO by wt.
3. Pluronic ® F38, M.W. 4,700, HLB 30.5, 80% EO by wt.
4. Pluronic ® L31, M.W. 1,100, HLB 4.5, 10% EO by wt.
5. Pluronic ® 25R8, M.W. 8,550, HLB 12.0, 80% EO by wt.
6. Tetronic ® 908, M.W. 25,000, HLB 30.0, 80% by wt.
7. Industrol ® DW-5 (commercially available from BASF).

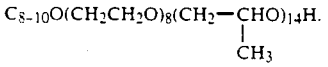

8. Neodol ® 45-13, (commercially available from Shell), $C_{14-15}O(CH_2CH_2O)_{13}H$.
9. Carbowax 8,000, (commercially available from Union Carbide), polyethylene glycol $HO(CH_2CH_2O)_nH$, M.W. 8,000.
10. Sodium polyacrylate

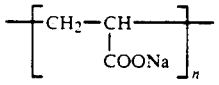

M.W. 4,500 and M.W. 60,000 based on acid form.

11. Sokalan ® CP5, (commercially available from BASF), acrylate/maleate copolymer, 70:30 by weight as acid, M.W. 70,000.

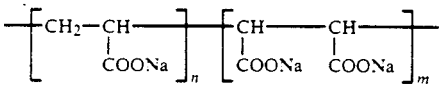

12. Sokalan ® CP7, (commercially available from BASF), acrylate/maleate copolymer, 50:50 by weight as acid, M.W. 50,000.

13. Builder U, (as described in U.S. Pat. Nos. 4,144,226 and 4,246,495) polyacetal carboxylate.

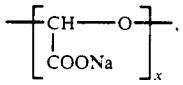

M.W. 10,000.

EXAMPLE III

The following example utilized the base composition of EXAMPLE I plus a mixture of ethylene oxide/propylene block copolymer and polycarboxylate. All of the following detergent compositions are within the scope of the present invention:

| Pluronic F98/Sodium Polyacrylate, M.W. 4,500 | | | |
|---|---|---|---|
| F98 (Weight Percent) | PAA 4.5M (Weight Percent) | Δ% Detergency | |
| 4 | 0 | 8.8 | 7.0 |
| 3 | 1 | 10.5 | — |
| 2 | 2 | 10.0 | 11.8 |
| 1 | 3 | 10.0 | — |
| 0 | 4 | 4.9 | 5.4 |
| 10 | 0 | 9.3 | |
| 7 | 3 | — | |
| 5 | 5 | 16.6 | |
| 3 | 7 | — | |
| 0 | 10 | 12.9 | |
| **Pluronic F98/Sodium Polyacrylate, M.W. 60,000** | | | |
| F98 (Weight Percent) | PAA 60M (Weight Percent) | Δ% Detergency | |
| 4 | 0 | 12.1 | 5.5 |
| 3 | 1 | 12.4 | 7.1 |
| 2 | 2 | 12.8 | 8.2 |
| 1 | 3 | 14.0 | 7.9 |
| 0 | 4 | 8.0 | 3.6 |
| 10 | 0 | 6.4 | |
| 5 | 5 | 11.6 | |
| 0 | 10 | 11.7 | |
| **Pluronic F98/Sokalan CP5** | | | |
| F98 (Weight Percent) | CP5 (Weight Percent) | Δ% Detergency | |
| 4 | 0 | 3.8 | |
| 3 | 1 | 7.4 | |
| 2 | 2 | 7.7 | |
| 1 | 3 | 6.4 | |
| 0 | 4 | 6.1 | |
| **Pluronic F98/Sokalan CP7** | | | |
| F98 (Weight Percent) | CP7 (Weight Percent) | Δ% Detergency | |

-continued

| | | | |
|---|---|---|---|
| 4 | 0 | 5.7 | 5.8* |
| 3 | 1 | 6.1 | 8.1* |
| 2 | 2 | 8.7 | 8.5* |
| 1 | 3 | 6.3 | 8.3* |
| 0 | 4 | 6.4 | 5.7* |

Pluronic F98/Builder U

| F98 (Weight Percent) | Builder U | Δ% Detergency | |
|---|---|---|---|
| 4 | 0 | 6.6 | 4.1* |
| 3 | 1 | 6.2 | 5.2* |
| 2 | 2 | 8.5 | 5.7* |
| 1 | 3 | 9.4 | 4.2* |
| 0 | 4 | 8.3 | 3.6* |

Pluronic F38/Sokalan CP7

| F38 (Weight Percent) | CP7 | Δ% Detergency |
|---|---|---|
| 4 | 0 | 5.0 |
| 3 | 1 | 7.3 |
| 2 | 2 | 7.4 |
| 1 | 3 | 8.0 |
| 0 | 4 | 5.5 |

Tetronic 908/Sokalan CP7

| 908 (Weight Percent) | CP7 | Δ% Detergency |
|---|---|---|
| 4 | 0 | 5.1 |
| 3 | 1 | 7.6 |
| 2 | 2 | 8.5 |
| 1 | 3 | 9.2 |
| 0 | 4 | 6.4 |

Pluronic 25R8/Sokalan CP7

| 25R8 (Weight Percent) | CP7 | Δ% Detergency |
|---|---|---|
| 4 | 0 | 6.6 |
| 3 | 1 | 8.6 |
| 2 | 2 | 9.0 |
| 1 | 3 | 9.3 |
| 0 | 4 | 8.0 |

*With 3% sodium silicate

As can be seen from the above data, the base composition of Example I plus mixtures of ethylene oxide/propylene oxide block copolymers and polycarboxylates provided significantly more clay soil removal than the base composition of Example I plus equivalent total amounts of such block copolymers or polycarboxylates alone.

COMPARATIVE EXAMPLES

The following examples utilized detergent compositions outside the scope of the present invention:

EXAMPLE IV

The following example utilized a detergent composition that differs from the base composition of EXAMPLE I in that it contains 16% LAS, 0% sodium carbonate, 8% sodium silicate and 25% sodium tripolyphosphate, a phosphorous detergent builder. However, the mixture of the ethylene oxide/propylene oxide block copolymer and polycarboxylate was within the definition of such mixture of the present invention.

Pluronic F98/Sodium Polyacrylate, M.W. 4,500 in a Phosphate System

| F98 (Weight Percent) | PAA 4.5M | Δ% Detergency |
|---|---|---|
| 4 | 0 | 3.2 |
| 3 | 1 | 4.7 |
| 2 | 2 | 4.8 |
| 1 | 3 | 5.1 |

-continued

Pluronic F98/Sodium Polyacrylate, M.W. 4,500 in a Phosphate System

| F98 (Weight Percent) | PAA 4.5M | Δ% Detergency |
|---|---|---|
| 0 | 4 | 4.5 |

As can be seen from the above data, the use of a detergent composition containing a phosphorous detergent builder plus such mixtures provided little enhanced clay soil removal as compared to such detergent composition plus equivalent total amounts of such block copolymer or polycarboxylate alone.

EXAMPLE V

The following example utilized the base composition of EXAMPLE I plus a mixture that was outside the scope of the definition of such mixture of the present invention because the ethylene oxide/propylene oxide block copolymer comprised less than about 70% ethylene oxide by weight.

Pluronic L92 or L31/Sokalan CP7

| L92 or L31 (Weight Percent) | CP7 | Δ% Detergency (L92) | (L31) |
|---|---|---|---|
| 4 | 0 | 11.9 | 4.1 |
| 3 | 1 | 10.8 | 6.1 |
| 2 | 2 | 11.5 | 5.8 |
| 1 | 3 | 10.8 | 7.6 |
| 0 | 4 | 9.3 | 8.0 |

As can be seen from the above data, the base composition of EXAMPLE I plus the mixture of such ethylene oxide/propylene oxide block copolymer and polycarboxylate provided no enhanced clay soil removal as compared to the base composition of EXAMPLE I plus equivalent total amounts of such ethylene oxide/propylene oxide block copolymer or polycarboxylate alone.

EXAMPLE VI

The following example utilized the base composition of EXAMPLE I plus a mixture that was outside the scope of the definition of such mixture of the present invention because the ethylene oxide/propylene oxide block copolymer was replaced with the nonionic surfactant DW-5.

Industrol DW-5/Sodium Polyacrylate, M.W. 4,500

| DW-5 (Weight Percent) | PAA 4.5M | Δ% Detergency |
|---|---|---|
| 4 | 0 | 5.5 |
| 3 | 1 | 5.7 |
| 2 | 2 | 4.6 |
| 1 | 3 | 3.4 |
| 0 | 4 | 3.6 |

As can be seen from the above data, the base composition of EXAMPLE I plus the mixture of such nonionic surfactant and polycarboxylate provided no enhanced clay soil removal as compared to the base composition of EXAMPLE I plus equivalent total amounts of such nonionic surfactant or polycarboxylate alone.

EXAMPLE VII

The following example utilized the base composition of EXAMPLE I plus a mixture that was outside the scope of the definition of such mixture of the present invention because the ethylene oxide/propylene oxide block copolymer was replaced with Neodol 45-13, an alcohol ethoxylate derived from the addition of ethylene oxide to a $C_{14-15}$ alcohol.

| Neodol 45-13/Sokolan CP7 | | |
|---|---|---|
| 45-13 (Weight Percent) | CP7 | Δ% Detergency |
| 4 | 0 | 4.1 |
| 3 | 1 | 3.4 |
| 2 | 2 | 5.4 |
| 1 | 3 | 5.3 |
| 0 | 4 | 7.4 |

As can be seen from the above data, the base composition of EXAMPLE I plus the mixture of Neodol 45-13 and polycarboxylate provided no enhanced clay soil removal as compared to the base composition of EXAMPLE I plus equivalent total amounts of Neodol 45-13 or polycarboxylate alone.

EXAMPLE VIII

The following examples utilized the base composition of EXAMPLE I plus a mixture that was outside the scope of the definition of such mixture of the present invention because the ethylene oxide/propylene oxide block copolymer was replaced with Carbowax 8,000, a polyethylene glycol.

| Carbowax 8,000/Sodium Polyacrylate, M.W. 4,500 | | |
|---|---|---|
| Carb. 8M (Weight Percent) | PAA 4.5M | Δ% Detergency |
| 2 | 0 | 6.8 |
| 1 | 1 | 7.7 |
| 0 | 2 | 3.6 |
| 10 | 0 | 4.2 |
| 5 | 5 | 9.5 |
| 0 | 10 | 12.9 |
| 4 | 0 | 1.9 |
| 2 | 2 | 6.4 |
| 0 | 4 | 5.4 |
| **Carbowax 8,000/Sodium Polyacrylate, M.W. 60,000** | | |
| Carb. 8M (Weight Percent) | PAA 60M | Δ% Detergency |
| 10 | 0 | −2.2 |
| 5 | 5 | 8.5 |
| 0 | 10 | 11.7 |
| **Carbowax 8,000/Builder U** | | |
| Carb. 8M (Weight Percent) | Builder | Δ% Detergency |
| 4 | 0 | 2.3 |
| 3 | 1 | 4.1 |
| 2 | 2 | 7.6 |
| 1 | 3 | 13.1 |
| 0 | 4 | 12.6 |
| **Carbowax 8,000/Sokalan CP5** | | |
| (Weight Percent) | | |
| Carb. 8M | CP5 | Δ% Detergency |
| 4 | 0 | 3.2 |
| 3 | 1 | 4.8 |
| 2 | 2 | 7.5 |
| 1 | 3 | 6.9 |
| 0 | 4 | 7.2 |

As can be seen from the above data, the base composition of EXAMPLE I plus the mixture of Carbowax 8,000 and polycarboxylate provided little enhanced clay soil removal as compared to the base composition of EXAMPLE I plus equivalent total amounts of Carbowax 8,000 or polycarboxylate alone.

What is claimed is:

1. A detergent composition comprising:

(a) from 5% to about 50% by weight of an organic surfactant selected from the group consisting of anionic, cationic, nonionic, zwitterionic and ampholytic surfactants, and mixtures thereof;

(b) from 5% to about 80% by weight of a nonphosphorous detergent builder; and (c) from about 1% to about 30% of a mixture of an ethylene oxide/propylene oxide block copolymer and a polycarboxylate, in which mixture the ethylene oxide/propylene oxide block copolymer: polycarboxylate weight ratio is from about 1:3 to about 3:1, said ethylene oxide/propylene oxide block copolymer having a weight average molecular weight of from about 1,000 to about 50,000 wherein said ethylene oxide/ propylene oxide block copolymer comprises at least about 80% ethylene oxide by weight, and said polycarboxylate comprises a homopolymer or copolymer formed of monomers having the general formula:

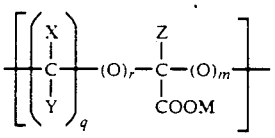

wherein X and Z are each hydrogen, hydroxy or methyl, Y is hydrogen or COOM; each M is selected from the group consisting of hydrogen, alkali metal, ammonium and substituted ammonium, m, r and q, at the same time, are 0, 0 and 1, respectively, or m, r and q, at the same time, are 1, 0 and 0, respectively; and the weight average molecular weight of said polycarboxylate is from about 4,000 to about 75,000.

2. The detergent composition of claim 1 wherein said mixture of said ethylene oxide/propylene oxide block copolymer and polycarboxylate is from about 1% to about 20% by weight.

3. The detergent composition of claim 2 wherein said mixture of said ethylene oxide/propylene oxide block copolymer and polycarboxylate is form about 2% to about 10% by weight.

4. The detergent composition of claim 1 wherein said organic surfactant is selected from the group consisting of alkali metal salts of $C_{11-13}$ alkylbenzene sulfonates, $C_{12-18}$ alkyl sulfates, $C_{12-18}$ alkyl linear polyethoxy sulfates containing from about 1 to about 10 moles of ethylene oxide, and nonionic surfactants that are the condensation products of alcohols having an alkyl group containing from about 9 to about 15 carbon atoms with from about 4 to about 12 moles of ethylene oxide per mole of alcohol.

5. The detergent composition of claim 1 wherein said nonphosphorous detergent builder is selected from the group consisting of zeolites, amorphous aluminosilicates, carbonates, citrates and silicates.

6. The detergent composition of claim 5 wherein said nonphosphorous detergent builder is selected from the group consisting of Zeolite A, amorphous aluminosilicates, sodium carbonate, sodium citrate and sodium silicate.

7. The detergent composition of claim 1 wherein said ethylene oxide/propylene oxide block copolymer has a weight average molecular weight of from about 4,000 to about 30,000.

8. The detergent composition of claim 1 wherein said ethylene oxide/propylene oxide block copolymer is selected from the group consisting of:

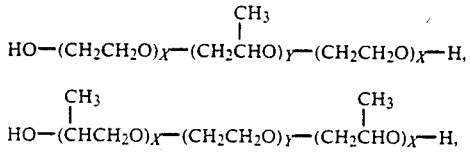

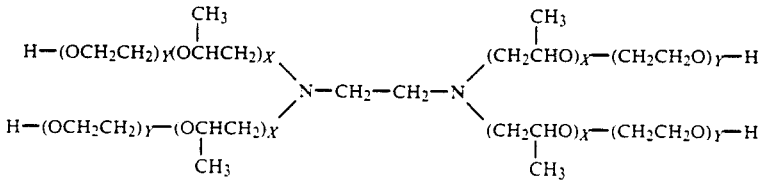

and

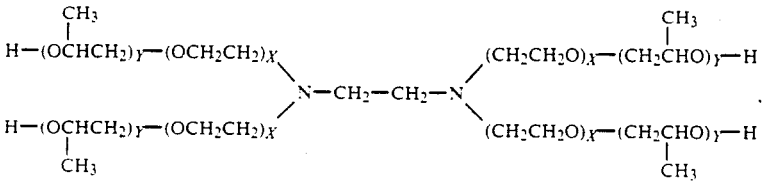

wherein each X and Y is an integer.

9. The detergent composition of claim 1 wherein said polycarboxylate is selected from the group consisting of polyacetal carboxylates and copolymers of sodium acrylate and sodium maleate.

10. The detergent composition of claim 1 comprising from about 10% to about 30% by weight organic surfactant and from about 10% to about 70% by weight nonphosphorous detergent builder.

* * * * *

UNITED STATES PATENT AND TRADEMARK OFFICE

CERTIFICATE OF CORRECTION

PATENT NO. : 5,049,303

DATED : September 17, 1991

INVENTOR(S) : Secemski et al.

It is certified that error appears in the above-identified patent and that said Letters Patent is hereby corrected as shown below:

Title page of the Patent; Please add to the "References Cited" "U.S. Patent Documents" area:

-- 4,490,271 12/1984 Spadini et al. 252/174.23
4,657,693 4/1987 Wise et al. 252/174.21
4,689,167 8/1987 Collins et al. 252/95
4,608,188 8/1986 Parker et al. 252/99 --

Title page of the Patent; Please add to the "References Cited" "Foreign Patent Documents" area:

-- EP 0,165,136 12/1985 Europe --

Signed and Sealed this

Twenty-third Day of February, 1993

*Attest:*

STEPHEN G. KUNIN

*Attesting Officer*

*Acting Commissioner of Patents and Trademarks*